US005276415A

United States Patent [19]

Lewandowski et al.

[11] Patent Number: 5,276,415

[45] Date of Patent: Jan. 4, 1994

[54] SELECTABLE AC OR DC COUPLING FOR COAXIAL TRANSMISSION LINES

[76] Inventors: Robert J. Lewandowski, 673 NW. 178th Pl., Seattle, Wash. 98177; Daniel G. Dow, 9620 NE. 31st, Bellevue, Wash. 98004; Frederick J. Telewski, 24600 NE. 171st, Woodinville, Wash. 98072

[21] Appl. No.: 900,328

[22] Filed: Jun. 18, 1992

[51] Int. Cl.[5] ..... H01P 5/00

[52] U.S. Cl. ..... 333/260; 333/24 C; 333/262; 439/188; 439/620

[58] Field of Search ..... 333/24; 439/171, 173, 439/174, 188, 578, 620, 805

[56] References Cited

U.S. PATENT DOCUMENTS

| | | | |
|---|---|---|---|
| 2,516,529 | 7/1950 | Raymond | 333/24 C X |
| 3,120,985 | 2/1964 | Hubbell . | |
| 3,391,262 | 7/1968 | Twitchell, Jr. | 200/51.02 |
| 3,730,971 | 5/1973 | Durham et al. . | |
| 3,944,316 | 3/1976 | Newman et al. . | |
| 3,980,976 | 9/1976 | Tadama et al. | 333/260 X |
| 3,982,803 | 9/1976 | Bennett | 439/578 X |
| 4,660,921 | 4/1987 | Hauver | 439/578 |

*Primary Examiner*—Paul Gensler

[57] ABSTRACT

A compact selectable AC/DC coaxial coupling having a cylindrical signal coupling capacitor disposed within a section of coaxial transmission line. Inner and outer plates of the capacitor are electrically connected to an external connector and the center conductor of the transmission line, respectively. A radially biased conductive collet or a conductive mesh axially disposed on the center conductor is biased into and out of contact with the inner plate of the capacitor to enable or disable DC coupling. Alternatively, a resilient contact member is displaced through an externally accessible actuating rod to connect the center conductor to the inner plate of the capacitor. The integral nature of these switching mechanisms within a coaxial environment provides both low insertion losses and continuous impedance matching.

21 Claims, 3 Drawing Sheets

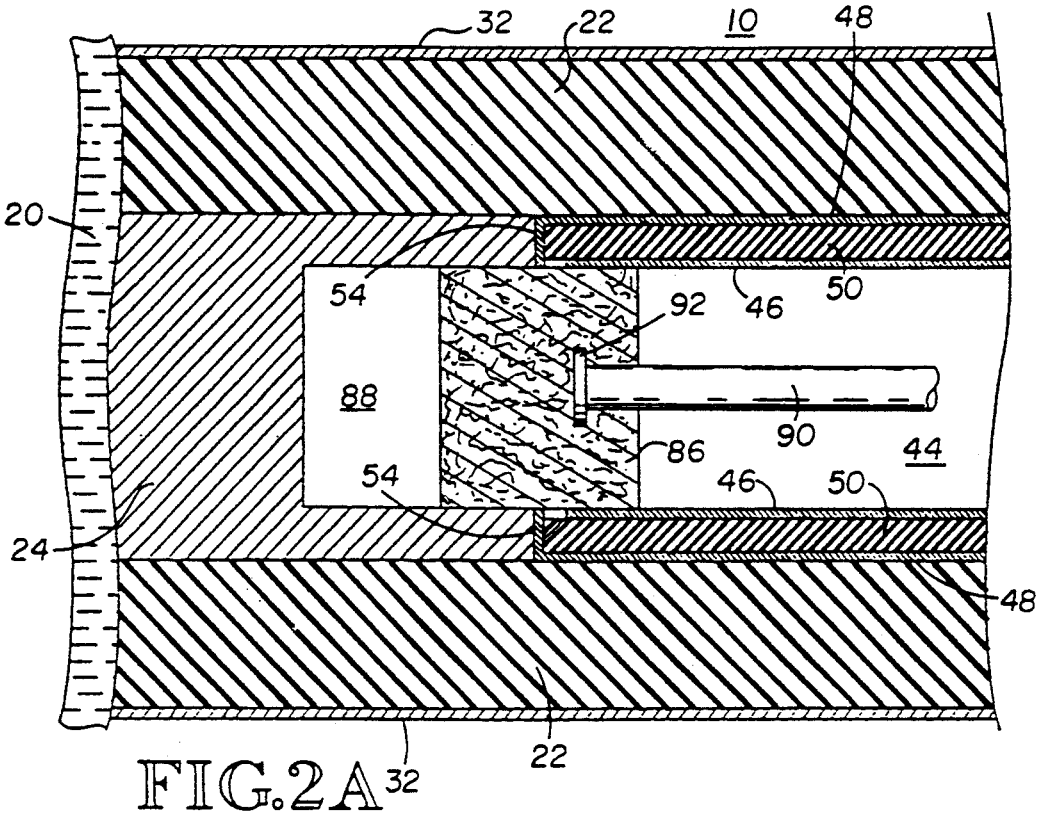
FIG.2A
FIG.2B
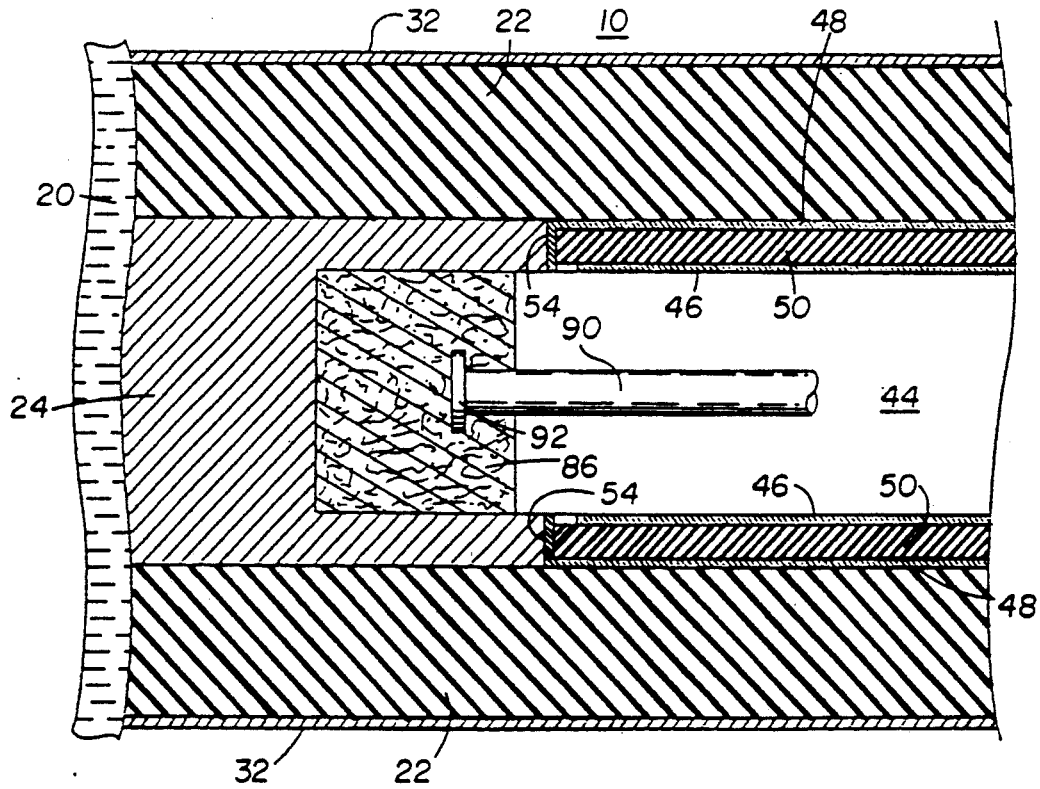

SELECTABLE AC OR DC COUPLING FOR COAXIAL TRANSMISSION LINES

TECHNICAL FIELD

The invention relates generally to a selectable AC/DC signal coupling and more particularly to a selectable AC/DC signal coupling for use within a coaxial transmission line.

BACKGROUND OF THE INVENTION

The practice of selectably coupling a signal in either DC or AC modes is important in such fields as electrical testing apparatus. A basic AC or DC coupling selection circuit includes a capacitor connected in parallel with a conventional SPST switch. When the switch is open, AC current flows through the capacitor while DC current flow is blocked by the capacitor. Conversely, when the switch is closed, both DC and AC current flow through the switch, bypassing the capacitor.

However, simple circuit embodiments of a selectable AC/DC coupler are impractical in most high frequency environments. Typical implementation of the simple capacitor-switch circuit has been attained by utilizing commercially available components and hooking them together conventionally by using printed circuit boards or other modular techniques. Such circuits are often unwieldy, and suffer high insertion losses when utilized within precision environments requiring shielded transmission lines such as coaxial cables. In particular, the transition from signal source to coupler and from coupler to a reception point of interest invariably creates impedance mismatching which can give rise to significant standing wave problems. Also, variations in the positions of switches can affect the electrical properties of the coupler. Movement of the switch has an affect on the field thus altering the characteristic impedance of the coupler.

SUMMARY OF THE INVENTION

It is an object of the present invention to provide a selectable AC or DC coupler disposed conveniently within a section of coaxial transmission line.

It is another object of the present invention to provide a selectable AC or DC coupling which can be easily switched between its AC and DC operating modes.

It is still another object of the invention to provide a selectable AC or DC coupling for a coaxial transmission line that can operate over a wide range of frequencies with minimum degradation of insertion loss, or the introduction of impedance mismatches.

A further object of the invention is to provide a selectable AC or DC coupling that is light in weight, inexpensive and easily adapted to a wide variety of mechanical and electrical characteristics.

These and other objects of the invention are provided by a selectable AC or DC coaxial coupling for use with a coaxial transmission line having a center conductor, a dielectric core surrounding the center conductor and an outer conductor surrounding the dielectric core. The coaxial coupling includes a cylindrical capacitor having a dielectric cylinder positioned between inner and outer electrically conductive cylindrical plates. The capacitor preferably has an outside diameter that is substantially equal to the outside diameter of the center conductor of the coaxial transmission line. The capacitor is mounted within the dielectric core with one of the plates electrically connected to the center conductor so that the dielectric core and the outer conductor surround the capacitor. The coupling also includes the center contact of a coaxial connector electrically connected to the other plate of the cylindrical capacitor, and a switch selectably switched between a DC position and an AC position. In the DC position, the switch connects the inner plate to the outer plate of the capacitor. In the AC position, the switch isolates the inner plate from the outer plate of the capacitor so that the center conductor is AC coupled to the center contact by the cylindrical capacitor and the intrinsic impedance of the coupling is substantially equal to the intrinsic impedance of the coaxial transmission line. The switch is preferably confined within the outer peripheries of the center conductor and the cylindrical capacitor so that it is isolated from the electric and magnetic fields within the cable and coupling at high frequencies. The outer plate of the capacitor is preferably electrically connected to the center conductor of the coaxial transmission line, and the inner plate is preferably electrically connected to the center contact of the coaxial connector. The switch can then be connected between the center conductor of the coaxial transmission line and the inner plate of the capacitor. The capacitor can be connected between the center conductor and the center contact by making the outer plate overlap one end of the dielectric cylinder that abuts the center conductor of the coaxial transmission line and the inner plate overlap the opposite end of the dielectric cylinder. A wide variety of conductive structures can be used as the switch including a conductive member extending axially from the center conductor into the interior of the dielectric cylinder. The conductive member is movable radially between the DC position in which the conductive member makes contact with the inner plate of the cylindrical capacitor and the AC position in which the conductive member is spaced apart from the inner plate of the cylindrical capacitor.

Still other objects and advantages of the present invention will become readily apparent to those skilled in the art from the following detailed description, wherein only the preferred embodiment of the invention is shown and described, simply by way of illustration of the best mode contemplated of carrying out the invention. As will be realized, the invention is capable of other and different embodiments, and its several details are capable of modifications in various obvious respects, all without departing from the invention. Accordingly, the drawing and description are to be regarded as illustrative in nature, and not as restrictive.

BRIEF DESCRIPTION OF THE DRAWINGS

FIGS. 2(*a*) and 2(*b*) are cross-sectional views of an alternative embodiment of the inventive selectable AC or DC coupling;

DETAILED DESCRIPTION OF THE INVENTION

Figure 1:
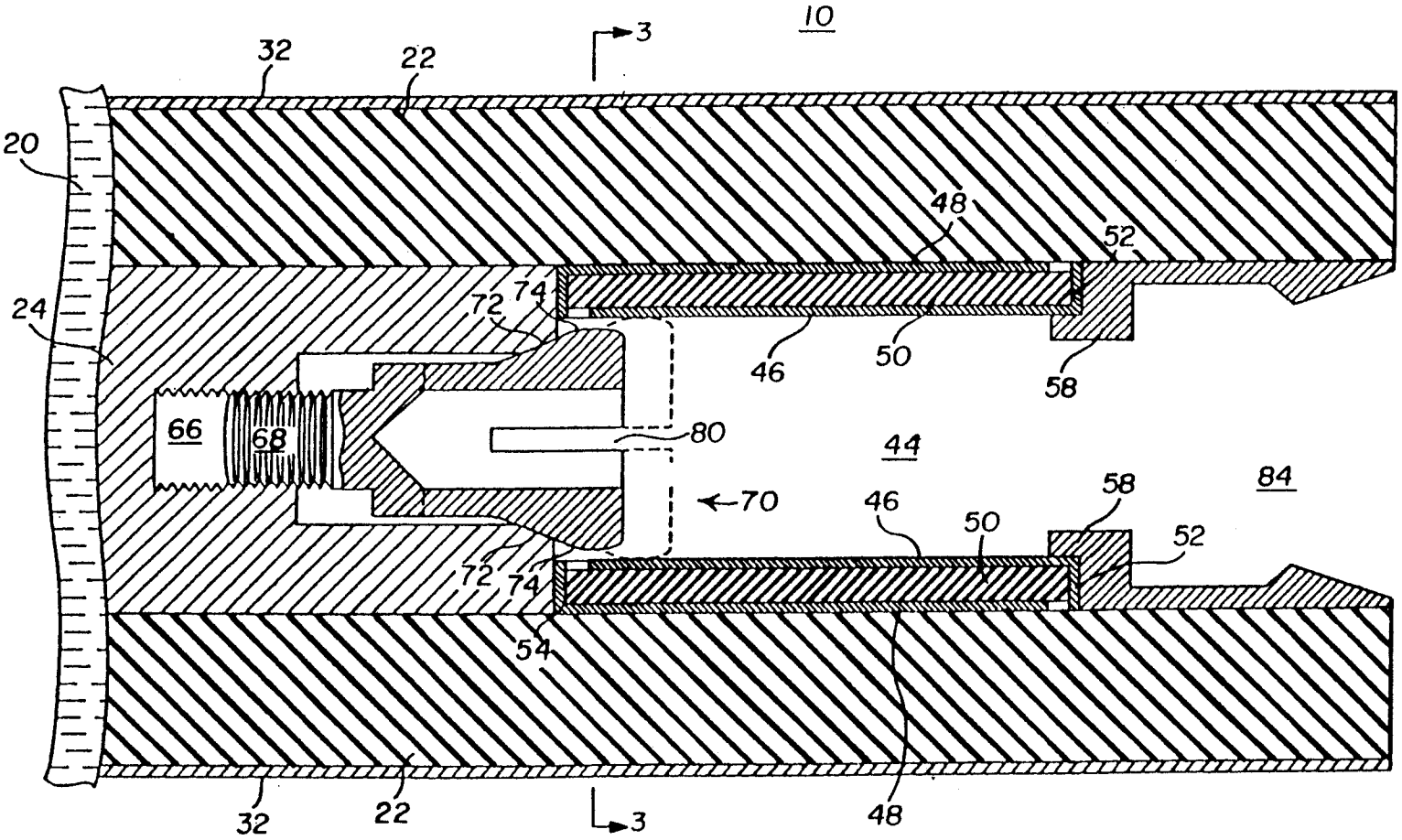
FIG. 1 is a cross-sectional view of one embodiment of the inventive selectable AC or DC coupling for coaxial transmission lines.

Referring now in detail to the drawings, and initially to FIG. 1, a selectable AC or DC coaxial coupling 10, in accordance with one embodiment of the present invention, is mounted within a coaxial transmission line 20 such as the type having a center conductor 24 running along its longitudinal axis, a dielectric core 22 surrounding the center conductor 24 and an electrically conductive shield 32 surrounding the dielectric core 22.

One embodiment of the selectable AC or DC coupling includes a signal coupling capacitor 44 having inner and outer electrically conductive plates 46 and 48, respectively, spaced apart from each other by a dielectric cylinder 50. The inner plate 46 preferably overlaps one end 52 of the dielectric cylinder, but stops short of making contact with the outer plate 48. Similarly, the outer conductive plate 48 preferably overlaps the other end 54 of the dielectric cylinder 50, but stops short of making contact with the inner plate 46. The dielectric cylinder 50 has an outside diameter that is approximately the same as the outside diameter of the center conductor 24 so that it is surrounded by the dielectric 22. The dielectric cylinder 50 is placed in the coaxial transmission line 20 with its end 54 abutting the end of the center conductor 24. As a result, the center conductor 24 makes contact with the outer plate 48 through the portion of the plate 48 that overlaps the end 54 of the dielectric cylinder 50. Similarly, a cylindrical center contact 58, part of coaxial connector 84, is also surrounded by the dielectric core 22. The center contact abuts the opposite end 52 of the dielectric cylinder 50. As a result, the center contact 58 connects to the inner plate 46 through the portion of the plate 46 that overlaps the end 52 of the dielectric cylinder 50. The capacitor 44 thus AC couples the center conductor 24 of transmission line 20 to the center contact 58 of the coaxial connector.

Figure 3:
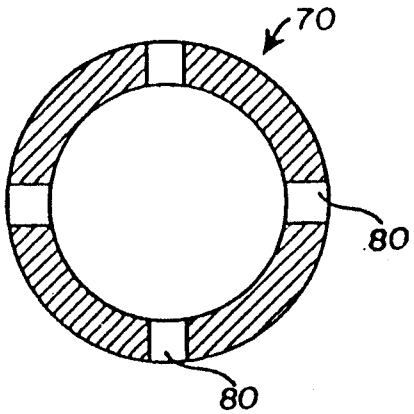
FIG. 3 is a cross-sectional view of a portion of the electrically conductive collet of the selectable AC or DC coupling taken along the line 3—3 of FIG. 1.

The center conductor 24 of transmission line 20 has formed therein an axially threaded bore 66 which receives a threaded shaft 68 of an electrically conductive collet 70. The collet 70 includes a cam face 72 and a contact surface 74. A slot 80 is formed in the collet 70, as also illustrated in FIG. 3. As explained below, the slot 80 receives a turning tool (not shown) through access bore in coaxial connector 84 in the center contact 58 to mechanically activate collet 70 and to provide axial movement of the collet 70 to allow the collet 70 to radially expand and contract due to cam surface 72.

It is important that the intrinsic impedance of the coupling 10 match the intrinsic impedance of the coaxial transmission line 20. Otherwise, an impedance mismatch between the coupling 10 and transmission line 20 will exist that will cause standing waves to be generated in transmission line 20. The intrinsic impedance of the coaxial transmission line 20 is proportional to the logarithm of the ratio of the inner diameter of the shield 32 to the outer diameter of the center conductor 24. The intrinsic impedance of the coaxial transmission line 20 is also inversely proportional to the square root of the dielectric constant of the dielectric core 22 between the center conductor 24 and the shield 32. The cylindrical capacitor 44, which couples the signal through the coaxial coupling 10, has a diameter that is substantially the same as the diameter of the center conductor 24. Furthermore, it is surrounded by the same dielectric core 22 and shield 32 that surrounds the center conductor 24. As a result, the inventive coaxial coupling has the same intrinsic impedance as the coaxial transmission line 20, and it therefore does not generate any standing waves in either transmission line 20 or a device (not shown) connected to the coaxial connector 84 as long as such device has the same impedance as transmission line 20.

The switch used to connect the center conductor 24 to the inner plate 46 of the cylindrical capacitor 44 is not critical, primarily because the DC and low frequency AC current that it passes is not affected by conductor geometry. Thus, virtually any type of switch can be used. However, for best results, the switch is preferably positioned at a location where it is isolated from the electric and magnetic fields within transmission line 20 and coupling 10 in the AC mode. If the switch is located within the electric and magnetic fields, it may significantly affect the high frequency AC characteristics of transmission line 20 and coupling 10, including their impedances and insertion losses.

The electric field in transmission line 20 extends radially between the center conductor 24 and the shield 32 while the magnetic field in transmission line 20 extends circumferentially in the dielectric core 22 between the center conductor 24 and the shield 32. Similarly, the electric field in the coupling 10 extends between the outer plate 48 of cylindrical capacitor 44 and the shield 32 and within dielectric cylinder 50 between outer plate 48 and inner plate 46 connected to center contact 58. The magnetic field in the coupling 10 extends circumferentially in the dielectric core 22 between the outer plate 48 of capacitor 44 and the shield 32 and within dielectric cylinder 50. By confining the switch within the periphery of the center conductor 24, the cylindrical capacitor 44, and the center contact 58, the switch is positioned out of the electric and magnetic fields between the shield 32 and the center conductor 24, cylindrical capacitor 44, and center contact 58. As a result, the switch does not significantly affect the high frequency AC characteristics of transmission line 20 and coupling 10. Since the switch only is effective at frequencies where the capacitive reactance of capacitor 44 is large, this frequency can be made arbitrarily low by the appropriate selection of the value of capacitor 44.

The selectable AC or DC coupling operates as follows. Assuming that the normal condition of the selectable AC or DC coaxial section is the DC coupling mode, the collet 70 is radially biased into contact with the inner plate 46 of capacitor 44. Since the inner plate 46 is electrically connected to the center contact 58 of coaxial connector 84, and the collet 70 is electrically connected to the center conductor 24, a DC transmission path is maintained when the contact surface 74 of the collet 70 contacts the inner plate 46.

When AC coupling is desired, a turning tool (not shown) is inserted through the access bore in coaxial connector 84 in the center contact 58 until the turning tool is positioned in one of the slots 80 on the collet 70 (FIG. 3). The contact surface 74 is initially biased into contact with the inner plate 46. As the tool is rotated, the cam face 72 is biased inwardly by the inner surface of center conductor 24, the contact surface 74 also moves radially inward until it loses contact with the inner plate 46. The center conductor 24, which is connected to the outer plate 48, is then AC coupled to the center contact 58 of coaxial connector 84 by the capacitance between inner and outer plates 46 and 48 of capacitor 44.

To return to DC coupling, the collet 70 is rotated in the opposite direction toward capacitor 44 to enable the collet contact surface 74 to become biased by the resilience of collet 70 back into contact with inner plate 46 thereby providing DC coupling.

A second embodiment of the selectable AC or DC coupling is shown in FIGS. 2(*a*) and 2(*b*). This second embodiment is basically identical in operation and structure to the first embodiment except for the collet 70. Consequently, in the interests of brevity, the same components in both embodiments have been given the same reference numeral, and an explanation of their structure will not be repeated.

Instead of using brass stock for the collet 70 as in the embodiment of FIG. 1, the embodiment of FIGS. 2*a* and 2*b* uses a wad of conductive mesh 86 positioned within a cylindrical bore 88 in the center conductor 24. An actuating rod 90 has an enlarged end 92 which is embedded in the mesh 86.

When DC coupling is desired, the mesh 86 is in the position illustrated in FIG. 2*a*. In this position, the conductive mesh 86 DC couples the center conductor 24 to the inner plate 46 of the capacitor 44. The inner plate 46 of the capacitor 44 contacts the center contact 58 (FIG. 1) of the coaxial connector 84.

When AC coupling is desired, the actuating rod 90 is displaced inwardly thereby moving the conductive mesh 86 within the cylindrical bore 88 as illustrated in FIG. 2*b*. In this position the mesh 86 is recessed entirely within the bore 88 so that it does not make contact with the inner plate 46 of the capacitor 44. As a result, coupling between the center conductor 24 and the coaxial connector 84 is through the capacitor 44.

Figure 4:
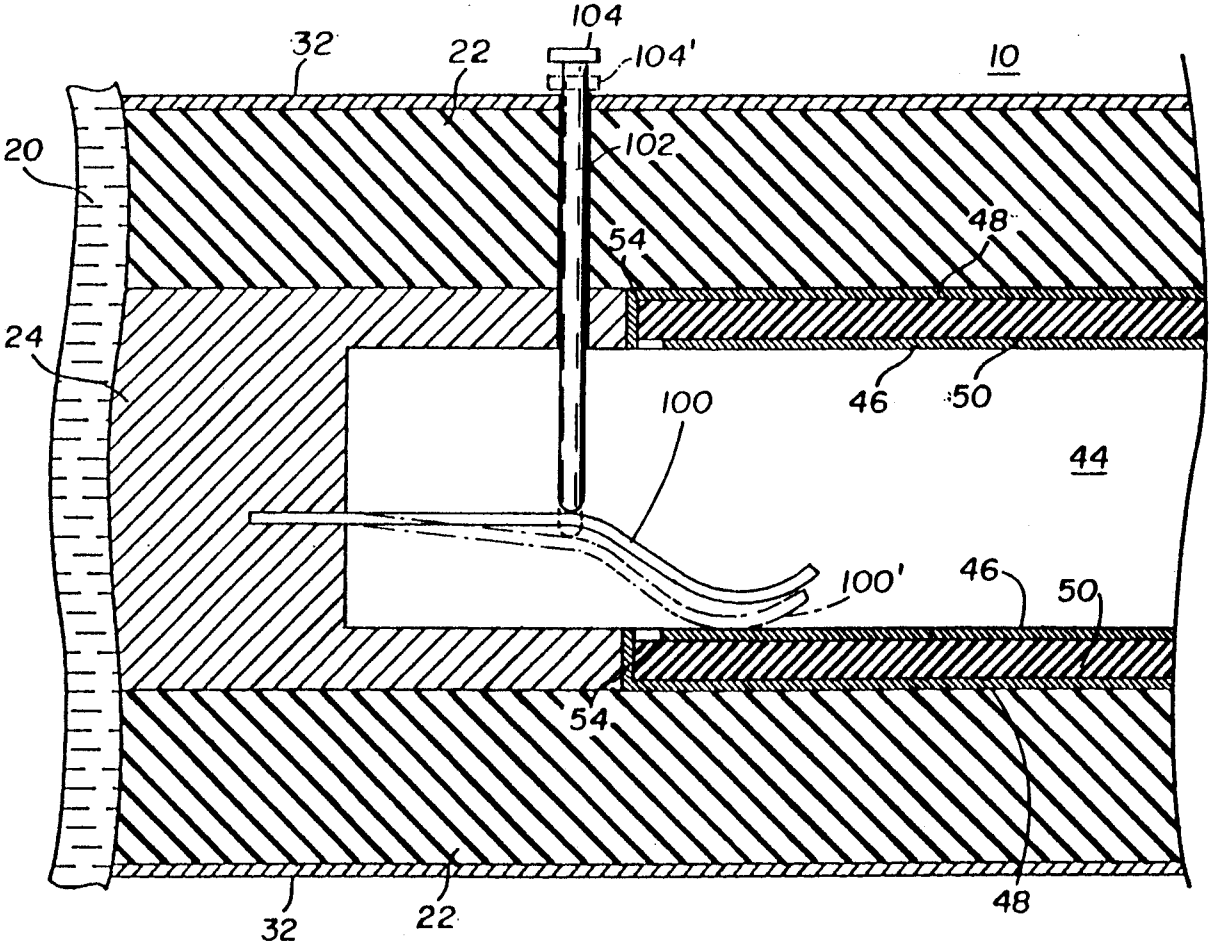
FIG. 4 is a cross-sectional view of another embodiment of the inventive selectable AC or DC coupling for coaxial transmission lines shown in its AC coupling position.

Another embodiment of the inventive selectable AC or DC coupling is illustrated in FIG. 4. This embodiment is also basically the same as the embodiments of FIGS. 1-3 except for the structure and mode of operation of the mechanism for selectively connecting the center conductor 24 of transmission line 20 to the inner plate 46 of the capacitor 44. In the embodiment of FIG. 1-3, the collet or mesh is moved axially and is recessed into the center conductor 24. In contrast, in the embodiment of FIG. 4 a spring contact 100 is moved radially by a dielectric plunger 102 extending from an externally accessible actuating button 104. The contact 100 is normally in the position 100. In this position the contact 100 is spaced apart from the inner plate 46 of the capacitor 44 thus AC coupling the center conductor 24 of the coaxial transmission line 20 to the coaxial connector 84. However, when the button 104 is pressed, it displaces the plunger 102 inwardly thereby moving the contact to the position 100′ shown in phantom in which it is positioned against the inner plate 46 of the capacitor 44. The coupling 10 then DC couples the center conductor 24 of transmission line 20 to the coaxial connector 84. The embodiment shown in FIG. 4 allows insertion of coupling 10 totally within a coaxial transmission line, coupling between two continuous center conductors and not requiring axial access to the end of the center conductor 24 through coaxial connector 84.

Is should also be noted that in the embodiment shown in FIG. 4 the contact could be biased to be in continual contact with the inner plate 46 of capacitor 44 and be displaced by plunger 102 to disconnect center conductor 24 from its DC connection to inner plate 46 of capacitor 44, allowing only AC coupling between center conductor 24 and coaxial connector 84.

It will be apparent that the structure of the mechanism for selectively connecting the center conductor 24 of transmission line 20 to the inner plate 46 of the capacitor 44 need not employ a mechanism of the type illustrated herein. A wide variety of other switch structures may also be used. Furthermore, although the inventive coupling 10 is shown in use for coupling a coaxial transmission line to a coaxial connector, it can also be used in other environments.

As is clear from the foregoing, the present invention provides a compact selectable AC or DC coupling 10 for coaxial transmission lines that is capable of coupling AC or DC signal sources to a point of interest without causing significant insertion loss or impedance mismatches. A typical use for the present invention can include measuring an AC signal in the presence of a DC signal which is not of interest.

Although there is shown and described only the preferred embodiments of the invention, it is to be understood that the invention is capable of use in other environments and is capable of changes or modifications within the scope of the inventive concept as expressed herein. For example, although the preferred embodiment provides longitudinal movement of threaded cam 72 by rotation thereof to selectively switch the coupling device between AC and DC coupling modes, other means for carrying out the longitudinal movement may be used, such as by indexing the cam through a longitudinal guideway using a tool or other means.

We claim:

1. A selectable AC or DC signal coupling for use in a coaxial transmission line of the type having a center conductor and a conductive shield coaxially surrounding said center conductor, said coupling comprising:

first and second center conductors of said coaxial transmission line axially spaced from each other;

a capacitor formed by outer and inner metalization sleeves on opposite surfaces of a dielectric sleeve, said outer and inner sleeves being connected, respectively, to said first center conductor of said coaxial transmission line and to said second center conductor of said coaxial transmission line;

a contact member connected to the first center conductor of said coaxial transmission line; and means for selectively moving said contact member into and out of contact with the inner sleeve of said capacitor to establish respective DC and AC signal flow paths through said coupling from said first center conductor to said second center conductor.

2. The selectable AC or DC signal coupling of claim 1 wherein said contact member is positioned within the interior of said inner metalization sleeve so that said contact member is isolated from electric and magnetic fields within said capacitor.

3. The selectable AC or DC signal coupling of claim 1 wherein said contact member comprises an electrically conductive, resilient collet inserted within said capacitor and normally in contact with said inner sleeve, and wherein said moving means includes means for biasing said collet out of contact with said inner sleeve.

4. The selectable AC or DC signal coupling of claim 3 wherein said first center conductor of said coaxial transmission line is formed with an interior cam surface, and said moving means includes means for moving said collet axially into contact with said cam surface.

5. The selectable AC or DC signal coupling of claim 4 wherein said collet is threaded into said first inner conductor whereby turning of said collet within said first inner conductor moves said collet axially.

6. The selectable AC or DC signal coupling of claim 1 wherein said capacitor is cylindrical.

7. The selectable AC or DC signal coupling of claim 1 wherein said contact member comprises electrically conductive mesh and said moving means includes means for moving said mesh axially within said capacitor.

8. The selectable AC or DC signal coupling of claim 1 wherein said capacitor has an outer diameter that is approximately equal to the inner conductor of said coaxial transmission line.

9. The selectable AC or DC signal coupling of claim 1 wherein said contact member includes a resilient conductive member projecting from said first center conductor, and wherein said moving means includes a nonconductive actuating rod extending radially through said coupling from said conductive member to an external location so that said conductive member may be moved against or away from said inner sleeve of said capacitor by external manipulation of said actuating rod.

10. The selectable AC or DC coupling of claim 9 wherein said conductive member is spaced from said inner sleeve of said capacitor, and wherein manipulation of said actuating rod displaces said conductive member into contact with said inner sleeve.

11. A selectable AC or DC coaxial coupling for use with a coaxial transmission line having a center conductor, a dielectric core surrounding said center conductor and an outer conductor surrounding said dielectric core, said coaxial coupling comprising:

a cylindrical capacitor having a dielectric cylinder positioned between inner and outer plates covering respective inner and outer cylindrical surfaces of said dielectric cylinder, said cylindrical capacitor having an outside diameter that is substantially equal to the outside diameter of the center conductor of said coaxial transmission line, said cylindrical capacitor being mounted within said dielectric core with one of said plates electrically connected to a first center conductor so that said dielectric core and said outer conductor surround said capacitor;

a second center conductor axially spaced from said first center conductor, said second center conductor being electrically connected to the other plate of said cylindrical capacitor; and a switch selectably switched between a DC position in which said switch connects said inner plate to said outer plate of said capacitor, and an AC position in which said switch isolates said inner plate from said outer plate of said capacitor so that said first center conductor is AC coupled to said second center conductor by said cylindrical capacitor and the intrinsic impedance of said coupling is substantially equal to the intrinsic impedance of said coaxial transmission line.

12. The selectable AC or DC coaxial coupling of claim 11 wherein said switch is confined within the outer peripheries of said center conductor and said cylindrical capacitor so that said switch is substantially isolated from high frequency electric and magnetic fields within said transmission line and coupling.

13. The selectable AC or DC coaxial coupling of claim 11 wherein said outer plate is electrically connected to said first center conductor of said coaxial transmission line, and said inner plate is electrically connected to said second center conductor.

14. The selectable AC or DC coaxial coupling of claim 11 wherein said switch is connected between the first center conductor of said coaxial transmission line and said inner plate of said capacitor.

15. The selectable AC or DC coaxial coupling of claim 13 wherein said outer plate overlaps an end of said dielectric cylinder that abuts said first center conductor of said coaxial transmission line and wherein said inner plate overlaps the opposite end of said dielectric cylinder, said opposite end abutting said second center conductor.

16. The selectable AC or DC coaxial coupling of claim 13 wherein said switch comprises a conductive member extending axially from said first center conductor into the interior of said dielectric cylinder, said conductive member being movable radially between said DC position in which said conductive member makes contact with the inner plate of said cylindrical capacitor and said AC position in which said conductive member is spaced apart from the inner plate of said cylindrical capacitor.

17. The selectable AC or DC coaxial coupling of claim 16 wherein said conductive member comprises an expandable collet that moves axially in a bore formed in said first center conductor, said bore having formed therein a sloped shoulder so that said shoulder compresses said collet away from the inner plate of said cylindrical capacitor as said collet moves into said bore, and said collet is allowed to expand against the inner plate of said cylindrical capacitor as said collet moves out of said bore.

18. The selectable AC or DC coaxial coupling of claim 17 wherein said collet is threaded into said bore, and wherein said collet is accessed for rotation in said bore through an access opening formed in the center of said second center conductor so that said collet is moved axially by inserting a tool through said access opening and the center of said cylindrical capacitor to engage and rotate said collet.

19. The selectable AC or DC coaxial coupling of claim 16 wherein said conductive member comprises a resilient contact member extending axially from said first center conductor into the interior of said dielectric cylinder, said contact member being spaced apart from the inner plate of said capacitor, said switch further including an actuating lever extending radially through said dielectric core to abut said contact member, said actuating lever being displaced inwardly to push said contact member radially into contact with the inner plate of said capacitor.

20. A method of selectably AC or DC coupling a signal through a coaxial transmission line having a first center conductor, a dielectric core surrounding said center conductor and an outer conductor surrounding said dielectric core, said method comprising:

placing a cylindrical capacitor in said coaxial transmission line within said dielectric core, said cylindrical capacitor having a dielectric cylinder positioned between inner and outer plates covering respective inner and outer cylindrical surfaces of said dielectric cylinder, said cylindrical capacitor having an outside diameter that is substantially equal to the outside diameter of the center conductor of said coaxial transmission line;

connecting one of the plates of said cylindrical capacitor to said first center conductor;

connecting the other of said plates to a second center conductor that is axially spaced from said first center conductor; and connecting the plates of said capacitor to each other in a DC operating mode so that said first center conductor is DC coupled to said second center conductor, and isolating the plates of said capacitor from each other in an AC operating mode so that said first center conductor is AC coupled to said second center conductor by said cylindrical capacitor and the intrinsic impedance of said coupling is substantially equal to the intrinsic impedance of said coaxial transmission line.

21. The method of claim 20 wherein the plates of said capacitor are connected to each other within the dielectric cylinder of said capacitor in said DC operating mode.

* * * * *